United States Patent [19]

Mehrer

[11] 4,062,152

[45] Dec. 13, 1977

[54] VACUUM SANDER

[76] Inventor: Donald D. Mehrer, 3216 29th Ave. West, Seattle, Wash. 98199

[21] Appl. No.: 681,216

[22] Filed: Apr. 28, 1976

[51] Int. Cl.[2] ..... B25B 25/00; B25B 55/06

[52] U.S. Cl. ..... 51/170 R; 51/387; 51/273

[58] Field of Search ..... 51/170 R, 180, 170 T, 51/170 PT, 386, 387, 393, 273, 390; 15/415 A, 393

[56] References Cited

U.S. PATENT DOCUMENTS

| | | | |
|---|---|---|---|
| 1,318,881 | 10/1919 | Kelley | 15/415 A |
| 1,800,341 | 4/1931 | Davies | 51/180 |
| 2,711,059 | 6/1955 | Ames | 51/390 |
| 3,722,147 | 3/1973 | Brenner | 51/180 |
| 3,815,292 | 6/1974 | Hutchins | 51/273 |

FOREIGN PATENT DOCUMENTS

| | | | |
|---|---|---|---|
| 629,586 | 8/1927 | France | 51/170 T |

*Primary Examiner*—James L. Jones, Jr.

*Assistant Examiner*—Roscoe V. Parker

*Attorney, Agent, or Firm*—Seed, Berry, Vernon & Baynham

[57] ABSTRACT

A vacuum sander including a porous abrasive sheet mounted on the front surface of a backing plate. A manifold covers the rear surface of the backing plate, and the interior of the manifold communicates with the abrasive sheet through a plurality of bores in the backing plate. The manifold is maintained at reduced pressure by a partial vacuum communicating with the manifold through a tubular handle which is secured to a hollow sleeve projecting from the rear of the manifold. The sleeve extends into the manifold through an aperture and is connected to the backing plate through a universal joint so that the handle can intersect the plate at virtually any angle. An air-impervious boot fastened between the slceve and the manifold prevents air from leaking into the manifold through the aperture. The residue produced by using the sander is collected by the vacuum in the manifold and conveyed to the vacuum source through the tubular handle.

15 Claims, 5 Drawing Figures

VACUUM SANDER

BACKGROUND OF THE INVENTION

1. Field of the Invention

This invention relates to material working tools and, more particularly, to a vacuum sander for abrasively removing material from a surface and collecting the removed residue.

2. Description of the Prior Art

In such fields as carpentry, masonry and drywall construction, it is often necessary to produce a smooth surface by sanding material from the surface. Often the surface to be sanded is not readily accessible to a workman without the use of ladders or scaffolding. Attempts have been made to solve this problem by mounting the sander at the end of a long handle through a universal joint. One such sanding device is disclosed in U.S. Pat. No. 2,711,059 issued to Ames. Since the removed residue is generally of a powder-like consistency, it is desirable to collect the residue without allowing it to disburse over a wide area. Although vacuum collecting devices have been previously employed for this purpose, they have not functioned satisfactory under all conditions and they are often too large and heavy to mount at the end of an elongated support member. In the field of drywall construction, for example, the abutting edges of plasterboard sheets are generally covered with paper tape and coated with a layer of plaster. The plaster is then sanded until a sufficient quantity of plaster is removed so that the plaster is flush with the faces of the sheets. Since drywall construction is generally at the later end of a construction project, it is important to collect plaster dust removed by the sander so that the dust does not interfere with subsequent construction stages such as painting or wallpapering.

SUMMARY OF THE INVENTION

A main object of this invention is to provide a sander which is capable of sanding a surface located at a substantial distance from a workman while collecting virtually all of the residue produced by the sanding.

It is a further object of the invention to provide a vacuum sander which is relatively light and compact and easy to use.

It is still another object of the invention to provide a particle-collecting sander which removes material at a faster rate than conventional sanders.

These and other objects of the invention are accomplished by a particle-removing sander having an abrasive sheet mounted on a backing plate and communicating with a vacuum manifold through a plurality of bores in the backing plate. The backing plate is connected to an elongated, hollow handle through a universal joint extending into the manifold and allowing fluid communication between the interior of the handle and the vacuum manifold. An air-impervious, flexible boot surrounds the universal joint to seal the manifold. The universal joint allows the handle to intersect the backing plate at virtually any angle so that the sander may be used on a remote surface while the particle residue produced by the sanding is collected by the vacuum within the manifold.

DETAILED DESCRIPTION OF THE INVENTION

Figure 1:
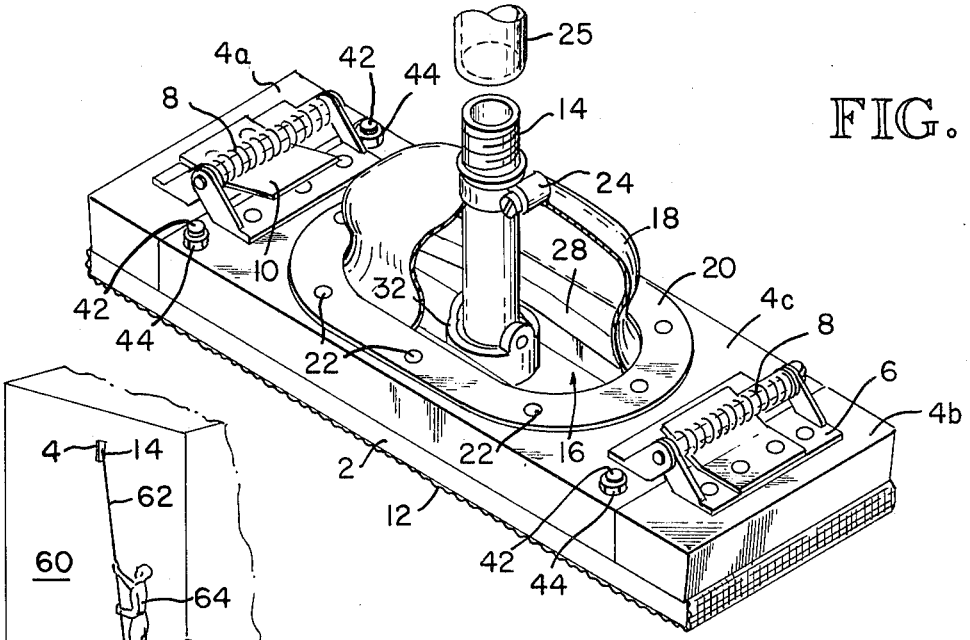
FIG. 1 is a top isometric view of the vacuum sander.
Figure 2:
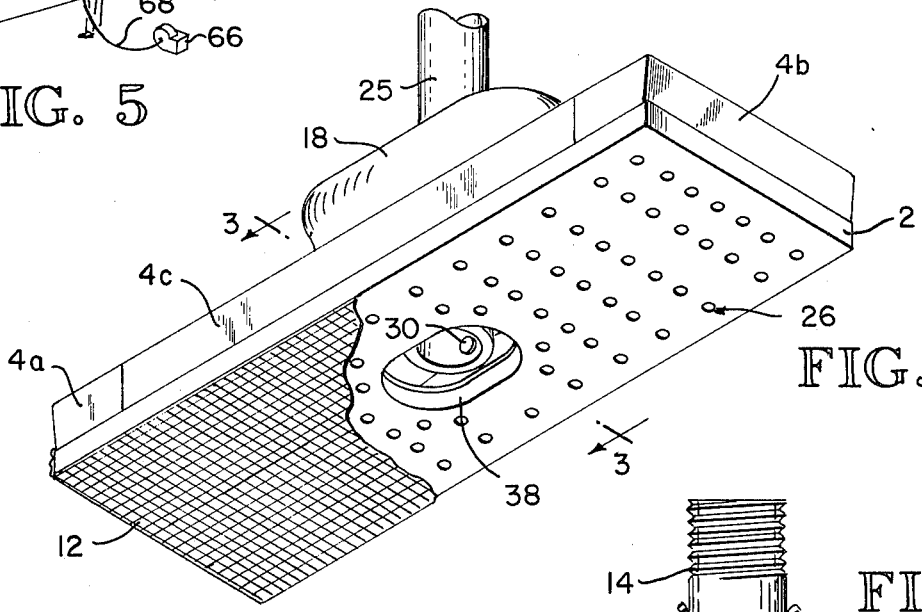
FIG. 2 is a bottom isometric view of the vacuum sander with a portion of the abrasive sheet cut away.
Figure 3:
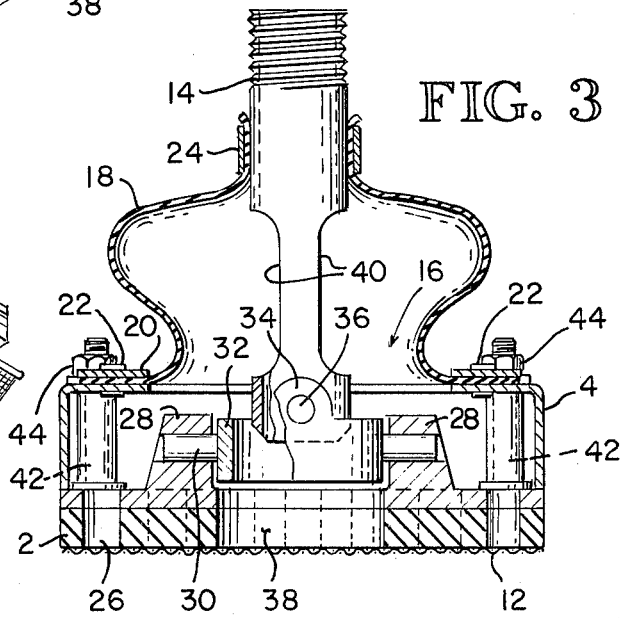
FIG. 3 is a cross-sectional view taken along the line 3—3 of FIG. 2.

As illustrated in FIGS. 1-3, the vacuum sander includes a rectangular backing plate 2 covered by a rectangular manifold 4. The end portions of the manifold 4a,b are secured to the center portion of the manifold 4c by hinges 6 which are biased toward the backing plate 2 by springs 8. A sheet of abrasive, air-permeable material 12 covers the external surface of the backing plate 2 and is inserted between the backing plate 2 and the manifold end portions 4a,b where it is retained by the clamping action of the manifold end portions 4a,b. Tabs 10 are secured at one end to the end portions 4a,b and are bent away from the manifold 4 toward the center of the vacuum sander. The manifold end portions 4a,b may be moved from the clamping position illustrated in FIG. 1 by pressing the inside ends of the tabs 10 toward the manifold 4.

The vacuum sander is supported during use through a hollow sleeve 14 projecting rearwardly through an aperture 16 (FIG. 3) in the manifold center portion 4c. A boot 18, fabricated from a sheet of air-impervious material, covers the aperture 16 to maintain the interior of the manifold 4 at reduced pressure. The boot 18 is secured to the manifold 4 by a ring 20 having a shape corresponding to the aperture 16. The boot 18 is sandwiched between the manifold 4 and ring 20, and the ring 20 is secured to the manifold 4 by rivets 22. The boot 18 is fastened about the periphery of the sleeve 14 by a clamp 24.

As best illustrated in FIG. 2, a plurality of through bores 26 are formed in the backing plate 2 for allowing air to enter the interior of the manifold 4 through the adhesive sheet 12. Residue removed from a workpiece by the abrasive sheet 12 is cleared from the sheet 12 by the air flowing therethrough into the interior of the manifold 4 which prevents clogging of the sheet 12 and dispersal of the residue over a wide area.

The internal structure of the sander, inluding the universal joint between the sleeve 14 and the backing plate 2, is best illustrated in FIG. 3. Bosses 28 having aligned apertures are integrally formed on the inside surface of the backing plate 2. A journal pin 30 extends between the bosses 28 through apertures in a coupling ring 32. The pin 30 allows the coupling ring 32 to pivot with respect to the plate 2 about a transverse axis. A second pair of aligned bosses 34 are integrally formed at the end of the coupling ring 32. The bosses 34 receive another journal pin 36 which extends through the end of the sleeve 14. The pin 36 allows the sleeve 14 to pivot with respect to the plate 2 about a longitudinal axis. A large central aperture 38 through the backing plate 2 prevents the end of the coupling ring 32 from striking the backing plate 2 as the ring 32 pivots with respect to the plate 2. A pair of cutouts 40 in the walls of the sleeve 14 receive the bosses 28 when the sleeve 14 is pivoted to one side so that the sleeve 14 does not strike the bosses 28. The universal joint allows the sleeve 14 to support the backing plate 2 with the sleeve 14 intersecting the plate 2 at a wide variety of angles while maintaining a vacuum within the manifold 4.

The manner in which the manifold 4 is secured to the backing plate 2 is illustrated in FIGS. 1 and 3. Threaded bosses 42 project from the inside surface of the backing plate 2 through bores in the manifold 4. The manifold 4 is then secured to the backing plate 2 by a nut 44 which is torqued against the manifold 4.

Figure 4:
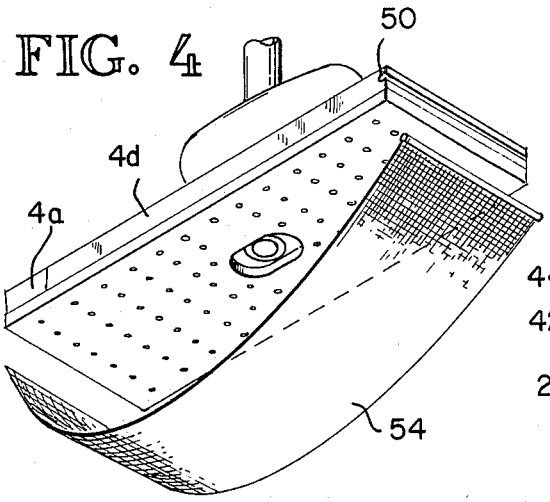
FIG. 4 is a bottom isometric view of an alternative embodiment of the vacuum sander utilizing a different mechanism for securing the abrasive sheet than the embodiment of FIGS. 1-3.

An alternate embodiment of the vacuum sander is illustrated in FIG. 4. The manifold 4 includes only one clamping portion 4*a* and one main portion 4*d*. The end of the main manifold portion 4*d* contains a transverse slot 50 which receives a plastic bead 52 formed at the end of an air-permeable abrasive sheet 54. The bead 52 is inserted in the slot 50 and the opposite end of the sheet 54 is inserted between the manifold 4 and the backing plate 2, and is retained by the clamping action of the end portion of the manifold 4*a*.

The vacuum sander may be further modified by placing a plurality of apertures along side walls of the manifold 4 to collect residue adjacent the edges of the abrasive sheet.

Figure 5:
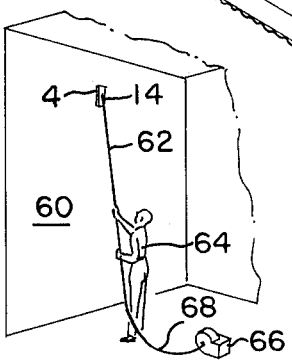
FIG. 5 is an isometric view illustrating the vacuum sander in use for sanding a wall.

The vacuum sander is illustrated sanding a wall 60 in FIG. 5. A tubular handle 62 is secured to the sleeve 14 and is supported by an operator 64 who moves the sander about while forcibly holding it against the wall 60. The lower end of the handle 62 communicates with a vacuum source 66 through a hose 68 so that the wall residue, which is removed by the sander, is collected by the vacuum source 66. The inventive vacuum sander thus allows an individual to sand objects remote from the individual while collecting the sanded residue to prevent spreading of the residue or clogging of the abrasive sheet.

The embodiments of the invention in which a particular property or privilege is claimed are defined as follows:

1. A vacuum sander comprising:
an abrasive sheet;
a sander body including a planar support plate for said abrasive sheet, securing means for fastening said sheet to the front face of said planar support plate and a vacuum manifold forming a vacuum chamber communicating with said abrasive sheet such that air draws sanding residue into said chamber;
a tubular sleeve communicating with said vacuum manifold, said sleeve being fastened to the rear face of said support plate through connector means for allowing the angle between said sleeve and support plate to vary over a predetermined range;
an elongated tubular handle having one end communicating with, and fastened to, said sleeve, and the other end communicating with a partial vacuum such that said vacuum chamber is maintained at a reduced pressure.

2. The vacuum sander of claim 1 wherein said connector means comprise a universal joint having two orthagonal pivot axes such that the angle between said sleeve and support plate is continuously adjustable within a predetermined range.

3. The vacuum sander of claim 1 wherein said planar support plate comprises a backing plate having a plurality of through bores, and wherein said vacuum manifold comprises an enclosure covering an inner surface of said backing plate and communicating with said abrasive sheet through said bores.

4. The vacuum sander of claim 1 wherein said manifold is segmented into a center portion and two end portions, and wherein said securing means comprise biasing means for urging said end portions against said support plate such that said abrasive sheet may be clamped between said end portions and backing plate.

5. In a vacuum sander having a backing plate for supporting an abrasive sheet, a vacuum manifold communicating with the other surface of said sheet, and a hollow, elongated handle having a first end connected to a partial vacuum and a second end, an improved coupling between said handle and manifold comprising:
a cylindrical sleeve extending through an aperture in said manifold, said sleeve having one end connected to the second end of said handle;
a universal joint connecting the second end of said sleeve to said backing plate; and
an air-impervious boot extending between said sleeve and manifold to cover said aperture and enclose said universal joint such that said handle may support said sander from a wide variety of angles while maintaining said manifold at a reduced pressure.

6. The vacuum sander of claim 5 wherein said sheet is an abrasive screen and whereupon said vacuum manifold communicates with the outer surface of said sheet by a plurality of bores through said backing plate.

7. The vacuum sander of claim 5 wherein said backing plate includes a pair of integrally formed aligned bosses extending into said vacuum manifold adjacent said aperture and wherein said universal joint comprises a coupling ring pivotally secured to said bosses along a first axis and pivotally secured to said sleeve along a second axis, said first axis being perpendicular to said second axis whereby the angle between said backing plate and sleeve is continuously adjustable within a predetermined range.

8. The vacuum sander of claim 7 wherein portion of said sleeve enclosed by said boot are cut away to provide clearance between said sleeve and backing plate thereby allowing greater freedom of motion between said sleeve and backing plate.

9. The vacuum sander of claim 5 wherein a side wall of said vacuum manifold includes a plurality of apertures adjacent said backing plate such that said vacuum manifold collects sandings adjacent said abrasive sheet through said apertures.

10. The vacuum sander of claim 5 wherein said vacuum vacuum manifold includes a pair of end portions connected to a center portion through a pair of hinges extending across a wall of said vacuum manifold, the outer edges of said end portions being resiliently biased against said backing plate such that said abrasive sheet may be fastened to said backing plate by placing said sheet between said plate and the outer edges of said end portions.

11. A vacuum sander comprising:
a planar, substantially rigid backing plate having a plurality of through bores, said plate having a resilient front surface and a pair of aligned bosses extending from its rear surface;
a sheet of air-permeable abrasive material secured to the front surface of said backing plate;
a closed manifold covering the rear surface of said backing plate to form a vacuum chamber, said manifold having an aperature in its rear wall adjacent said bosses;

a hollow, cylindrical sleeve extending through said aperture into said vacuum chamber;

a universal joint connecting said sleeve to said bosses such that said sleeve may intersect said backing plate at a wide variety of angles;

an air-impervious boot extending between said sleeve and the rear wall of said manifold to cover said aperture and enclose said universal joint; and a hollow, elongated handle having one end connected to a partial vacuum and the other end connected to said sleeve such that said abrasive sheet may engage a workpiece remotely positioned at a wide variety of angles with respect to said handle while dust produced from said workpiece by said abrasive sheet is collected by said vacuum chamber.

12. The vacuum sander of claim 11 wherein portions of said sleeve enclosed by said boot are cut away to provide clearance between said sleeve and backing plate thereby allowing greater freedom of motion between said sleeve and backing plate.

13. The vacuum sander of claim 11 wherein a side wall of said manifold includes a plurality of apertures adjacent said backing plate such that said manifold collects residue adjacent said abrasive sheet through said apertures.

14. The vacuum sander of claim 11 wherein said manifold includes a pair of end portions connected to a center portion through a pair of hinges extending across the back wall of said manifold, the outer edges of said portions being resiliently biased against said backing plate such that said abrasive sheet may be fastened to said backing plate by clamping said sheet between said plate and the outer edges of said end portions.

15. The vacuum sander of claim 11 wherein an elongated bead is formed along one end edge of said abrasive sheet and is received by a transverse slot extending along one end wall of said manifold thereby fastening said abrasive sheet to said manifold.

* * * * *